US010577846B2

(12) United States Patent
McKinnon

(10) Patent No.: US 10,577,846 B2
(45) Date of Patent: Mar. 3, 2020

(54) LOW PROFILE DOOR CLOSER

(71) Applicant: LIPPERT COMPONENTS, INC., Elkhart, IN (US)

(72) Inventor: Scott C. McKinnon, Union City, MI (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 0 days.

(21) Appl. No.: 16/026,277

(22) Filed: Jul. 3, 2018

(65) Prior Publication Data

US 2019/0010744 A1 Jan. 10, 2019

Related U.S. Application Data

(60) Provisional application No. 62/529,289, filed on Jul. 6, 2017.

(51) Int. Cl.
*E05F 1/10* (2006.01)

(52) U.S. Cl.
CPC ..... *E05F 1/1066* (2013.01); *E05F 1/1041* (2013.01)

(58) Field of Classification Search
CPC . E05F 1/08; E05F 1/1041; E05F 1/105; E05F 1/1066; E05F 1/1091; E05F 1/16
See application file for complete search history.

(56) References Cited

U.S. PATENT DOCUMENTS 107,813 A * 9/1870 Rankin ..... E05F 1/16 16/78
831,051 A * 9/1906 Flynn ..... E05F 1/16 16/67
897,825 A * 9/1908 Flynn ..... E05F 3/108 16/61
909,074 A * 1/1909 Flynn ..... E05F 1/16 16/67
1,095,634 A * 5/1914 Hobohm ..... E05F 1/1066 16/72
1,338,073 A * 4/1920 Dorl ..... E05F 1/105 16/78
1,471,830 A * 10/1923 Corey ..... E05F 1/1066 16/72
1,504,748 A * 8/1924 Dorl ..... E05F 1/105 16/78
1,730,948 A * 10/1929 Rosenthal ..... E05F 1/105 126/194
1,737,093 A * 11/1929 Price ..... E05F 1/1066 16/80
1,771,299 A * 7/1930 Justus ..... E05F 1/1066 16/72
3,018,507 A * 1/1962 Launer ..... E05F 1/16 16/78
3,683,551 A * 8/1972 Martindill ..... A62C 2/18 49/4
4,004,372 A 1/1977 Beard et al.
(Continued)

*Primary Examiner* — Jeffrey O'Brien
(74) *Attorney, Agent, or Firm* — Nixon & Vanderhye P.C.

(57) ABSTRACT

A door closer includes a helical extension spring disposed within a housing. A first end of the spring is attached to a spring anchor attached to a first end of the housing. A second end of the spring is attached to a first end of a strap. The strap passes through a strap guide attached to a second end of the housing. A second end of the strap is configured for attachment to a door jamb. The spring anchor and strap guide are configured for attachment to a door.

13 Claims, 7 Drawing Sheets

(56) References Cited

U.S. PATENT DOCUMENTS 4,317,254 A 3/1982 Chaddock
4,357,732 A 11/1982 Hickman
4,371,201 A 2/1983 Stock et al.
4,639,969 A 2/1987 Obenshain
4,649,598 A 3/1987 Kinsey et al.
4,722,116 A 2/1988 Erickson
4,819,295 A * 4/1989 Kaftan ..... E05F 1/16 16/71
4,845,811 A 7/1989 Fargnier
4,884,369 A 12/1989 Tatham
4,953,260 A 9/1990 Fargnier
5,002,331 A * 3/1991 Frye ..... E05F 13/02 16/71
5,170,530 A * 12/1992 Kopec ..... E05F 3/108 16/52
5,272,787 A 12/1993 Salena et al.
5,630,249 A * 5/1997 Rebai, Jr. ..... E05F 1/16 16/77
5,749,122 A 5/1998 Herbst
5,829,508 A 11/1998 DeBower et al.
6,691,465 B1 * 2/2004 Stephan ..... E05F 1/16 16/72
6,886,217 B2 5/2005 Foster
7,328,933 B2 * 2/2008 Vitale ..... E05F 11/04 296/146.4
7,356,878 B2 4/2008 Foster
7,547,058 B2 * 6/2009 King ..... B60J 5/101 296/146.8
8,656,554 B1 * 2/2014 Burleson ..... E05F 1/1066 16/72
9,441,406 B2 * 9/2016 Reid ..... E05F 3/108
2006/0207056 A1 * 9/2006 Wang ..... E05F 1/1066 16/78
2007/0063537 A1 * 3/2007 Preis ..... E05F 15/627 296/146.4
2009/0241287 A1 * 10/2009 Reid ..... E05F 3/108 16/58

* cited by examiner 20
14
10
16
12
18
16

62
20
14

20
10
12
18
16
122

12

12

LOW PROFILE DOOR CLOSER

CROSS-REFERENCE TO RELATED APPLICATIONS

This application claims benefit under 35 U.S.C. § 119 of U.S. Provisional Patent Application No. 62/529,289, filed on Jul. 6, 2017, and incorporates by reference the disclosure thereof in its entirety.

BACKGROUND AND SUMMARY OF THE DISCLOSURE

A door may be provided with a door closer configured to automatically close the door from an open position without further input from a user. A door closer typically includes an energy storage device configured to store energy imparted to the door when it is opened and to use the stored energy to close the door when it is released.

A door closer may be embodied as nothing more than a helical tension spring connected between the door and a mating door frame. Such a door closer has several drawbacks. For example, the bare spring may pinch a user when it retracts. Also, the spring may be exposed to the elements and become dirty or corroded as a consequence. Once dirtied or corroded, it may be difficult to clean. Even if clean and uncorroded, the spring may be unsightly. Further, the coils of the spring may routinely come into contact with, drag across, and abrade the edge of the door when the door is opened and closed.

Alternatively, a door closer may be embodied as a pneumatic tube including a cylinder connected to the door and a piston connected via a piston rod to the door jam. Such a door closer typically has a high profile, and may project away from the door and into adjacent living space. Also, such a door closer might not be aesthetically pleasing.

Some door closers include a hydraulic mechanism attached to a door and a linkage connecting the hydraulic mechanism to a door jam. Such door closers also have a high profile, and they can be unattractive and costly.

DETAILED DESCRIPTION OF THE DRAWINGS

Figure 1:
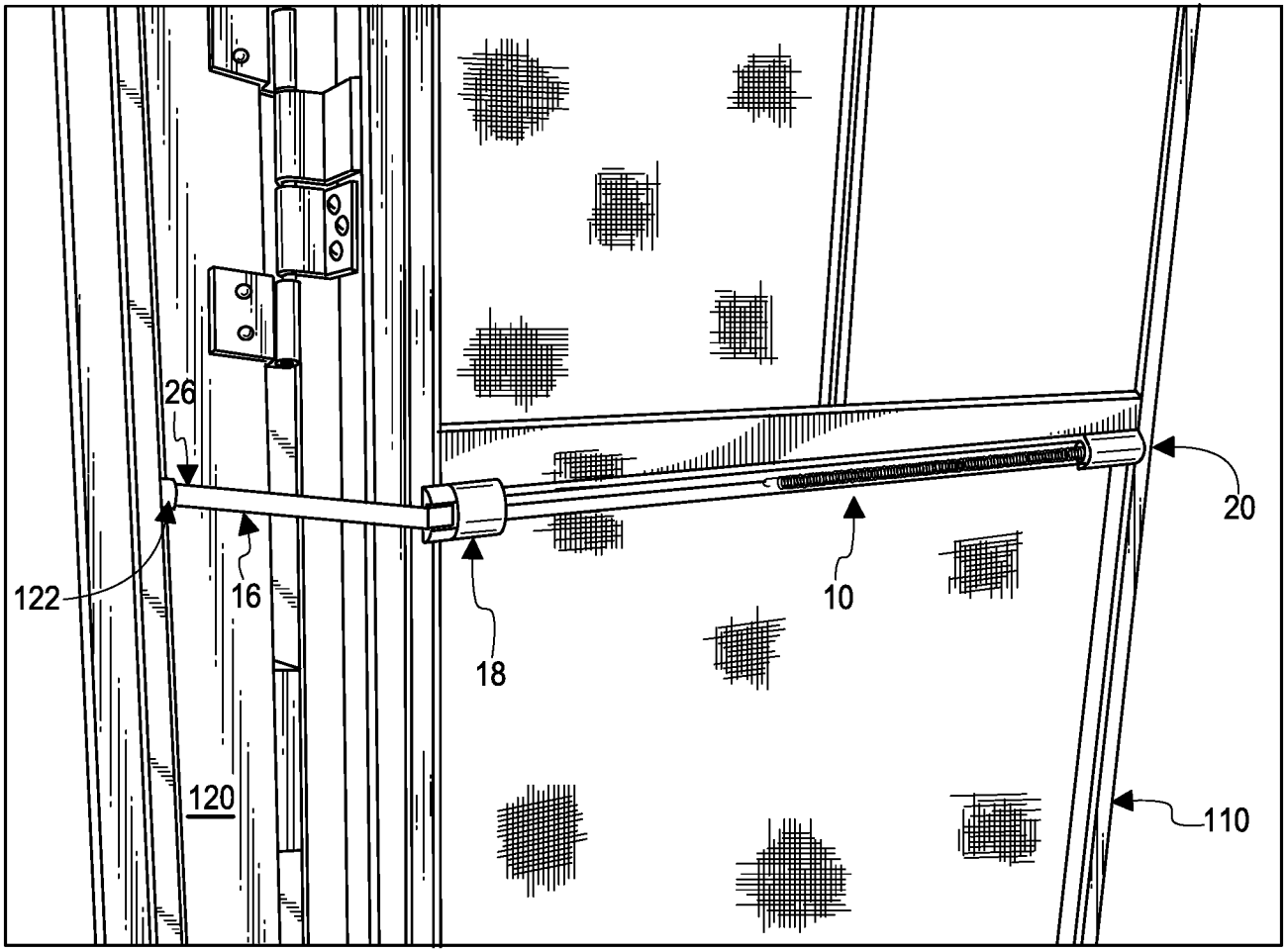
FIG. 1 is a photograph of a screen door pivotally connected to a door jamb and an illustrative door closer according to the present disclosure connected to the frame of the screen door and to the doorjamb.
Figures 2A, 2B, 2C, 3A, 3B:
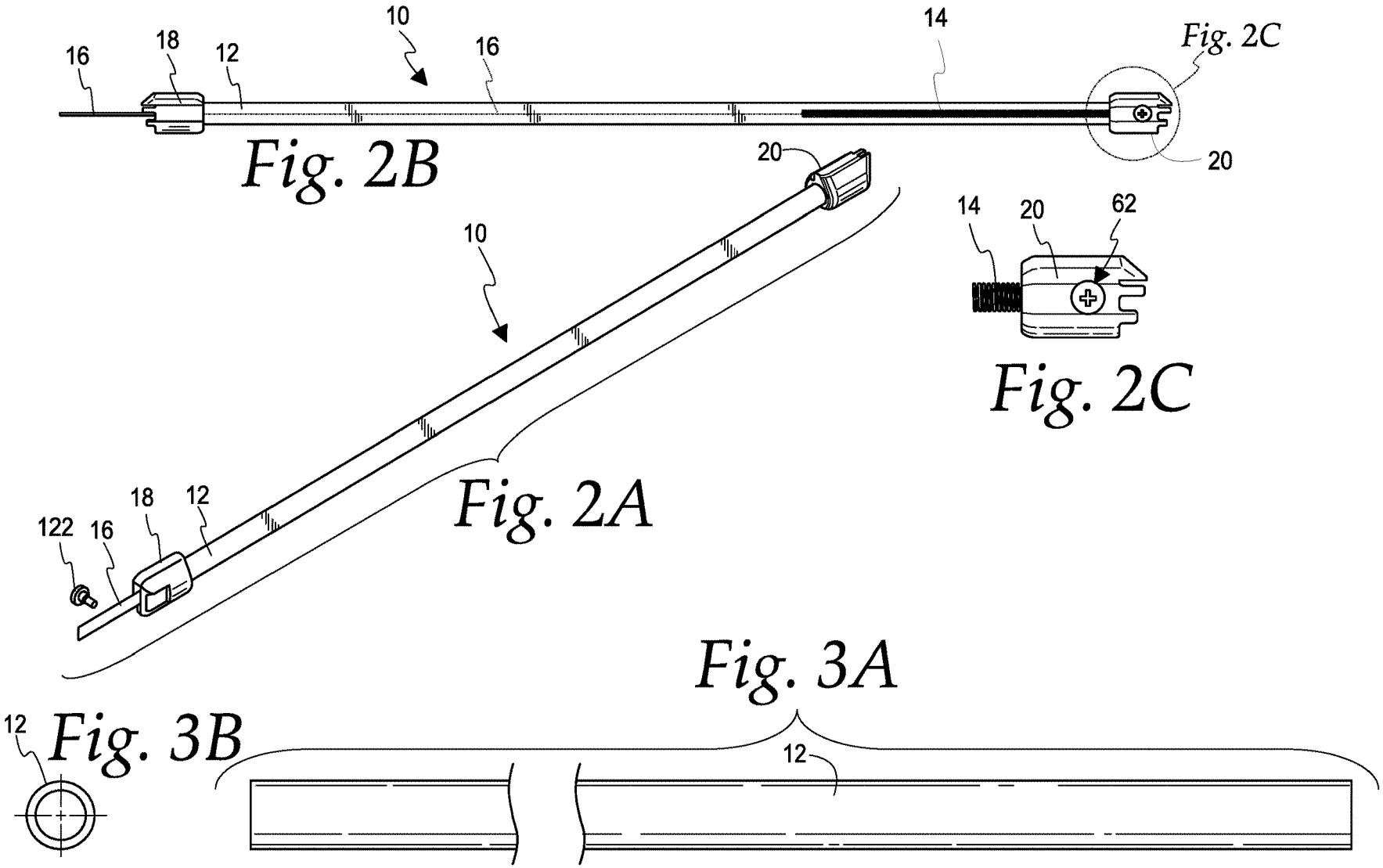
FIG. 2A is a perspective view of the door closer of FIG. 1.
FIG. 2B is a top plan view of the door closer of FIG. 1.
FIG. 2C is a detail view of a portion of the door closer of FIG. 1.
FIG. 3A is a side elevation view of a spring tube of the door closer of FIG. 1.
FIG. 3B is an end elevation view of the spring tube of the door closer of FIG. 1.
Figure 4B:
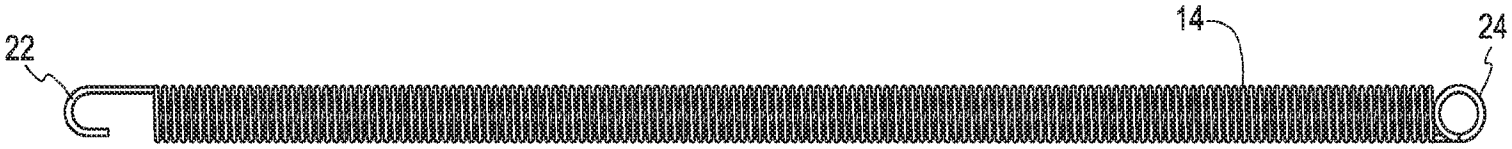
FIG. 4B is a side elevation view of the spring of the door closer of FIG. 1.
Figure 4A:
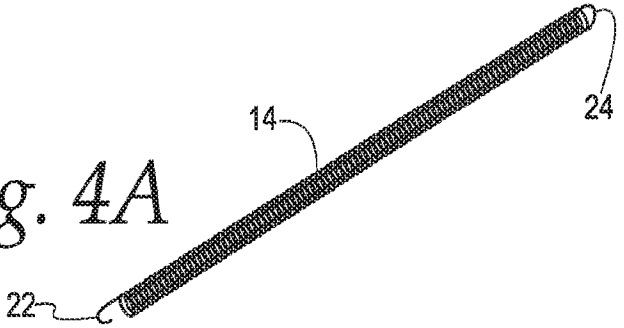
FIG. 4A is a perspective view of a spring of the door closer of FIG. 1.
Figure 4C:
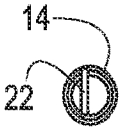
FIG. 4C is a first end view of the spring of the door closer of FIG. 1.

Dimensions and the like as may be shown in the drawings or described herein are illustrative and not limiting. References to orientation, for example, top, bottom, left, right, up, down, and the like are to be construed as references to relative orientation and should not be construed to refer to absolute orientation unless context clearly dictates otherwise.

The drawings show an illustrative embodiment of a door closer 10 configured for attachment to a door 110 and a door jamb 120 according to the present disclosure. The door closer 10 includes a housing 12, a spring 14 disposed within the housing, a strap 16 connected to a first end of the spring, a strap guide 18 connected to a first end of the housing, and a spring anchor 20 connected to a second end of the spring and to a second end of the housing.

The housing 12 is shown as an elongated tube configured to receive the spring 14 therein with sufficient clearance between an inner dimension of the housing and an outer dimension of the spring so that the spring may be extended and retracted within the housing without binding. In other embodiments, the housing 12 could take another form configured to receive the spring 14 therein with sufficient clearance between an inner dimension of the housing and an outer dimension of the spring so that the spring may be extended and retracted within the housing without binding.

The spring 14 is shown as a helical extension spring having a first hook 22 at a first end thereof and a second hook 24 at a second end thereof. The first spring hook 22 is configured for connection to a mating feature of the strap guide 18. As shown, the first spring hook 22 is J-shaped, but it could have other forms. The second spring hook 24 is configured for connection to a mating feature of the spring anchor 20. As shown, the second spring hook 24 is circle-shaped, but it could have other forms.

Figure 5A:
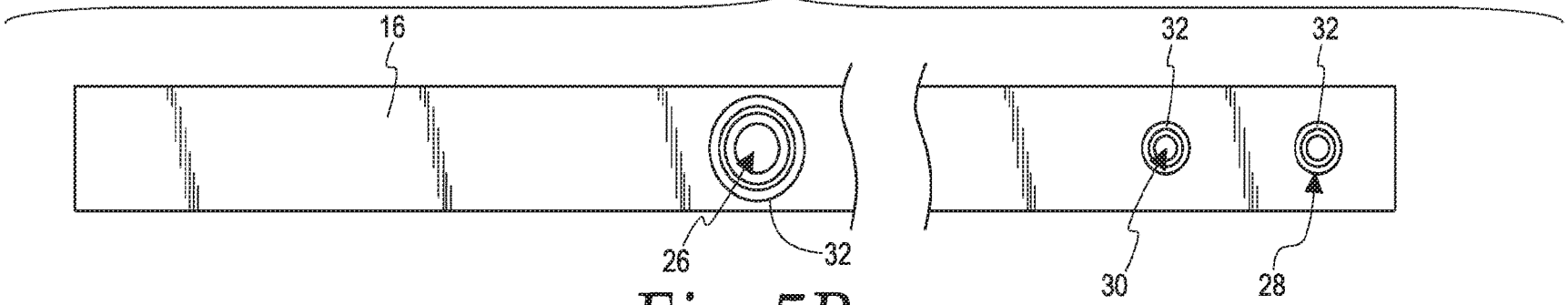
FIG. 5A is a side elevation view of a strap of the door closer of FIG. 1.
Figure 5B:
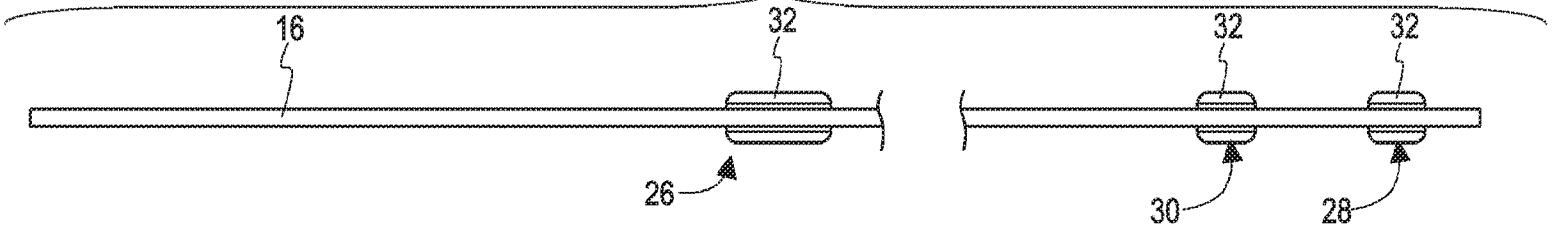
FIG. 5B is a top plan view of the strap of the door closer of FIG. 1.

The strap 16 is an elongated, thin, flexible member. The strap 16 could be embodied as fabric webbing, a sheet of flexible material, or in another suitable form. For example, the strap 16 could be embodied as a cable or a chain. The strap 16 is configured to define a first anchor point 26 near a first end thereof and a second anchor point 28 near a second end thereof. (As shown in FIGS. 5A and 5B, the first anchor point 26 may be spaced from the first end of the strap 16 by a sufficient distance to enable a user to grasp the first end of the strap and tension the strap when installing the system 10 to a door and door frame, as will become evident from the discussion further below.) The strap 16 may further be configured to define a third anchor point 30 near the second anchor point 28 and further from the second end of the strap than is the second anchor point (that is, between the first anchor point 26 and the second anchor point 28). Any or all of the first, second, and third anchor points 26, 28, 30 may be embodied as a perforation extending through the strap 16. An eyelet or grommet 32 made of brass or another suitable material may be connected to strap 16 in registration with the respective first, second, or third anchor point 26, 28, 30 to further define the respective anchor point and to mitigate wear of the strap during use, as will be discussed further below. In an embodiment, any or all of the anchor points 26, 28, 30 could be embodied as a structure attached to the strap and configured for attachment to the spring 14 or to a door frame, as will be discussed further below.

Figure 6A:
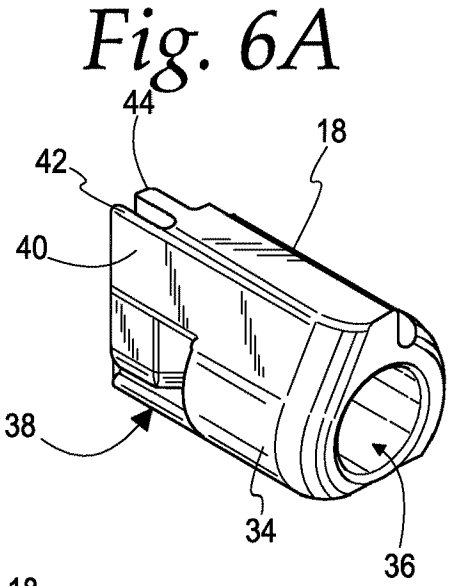
FIG. 6A is a perspective view of a strap guide of the door closer of FIG. 1.
Figure 6D:
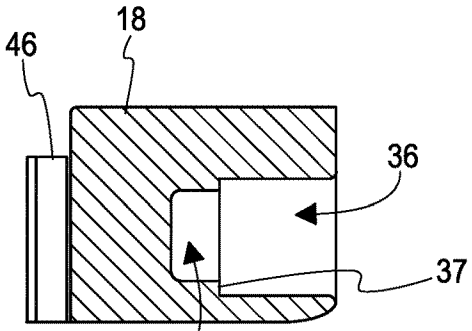
FIG. 6D is a cross-sectional side view of the strap guide of the door closer of FIG. 1.
Figure 6B:
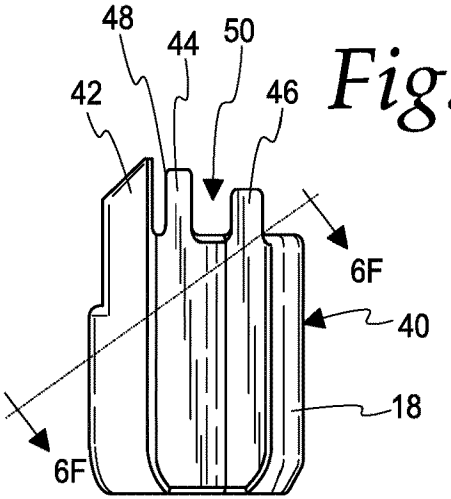
FIG. 6B is a top plan view of the strap guide of the door closer of FIG. 1.
Figure 6C:
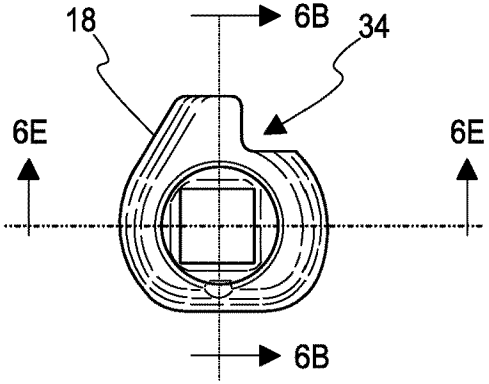
FIG. 6C is a first end elevation view of the strap guide of the door closer of FIG. 1.
Figure 6F:
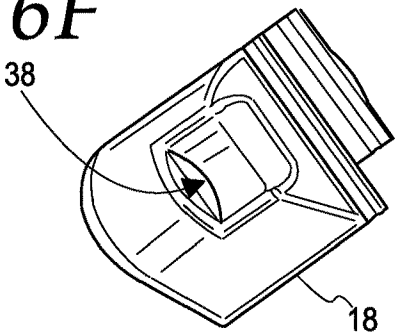
FIG. 6F is a cross-sectional perspective view of the strap guide of the door closer of FIG. 1.
Figure 6E:
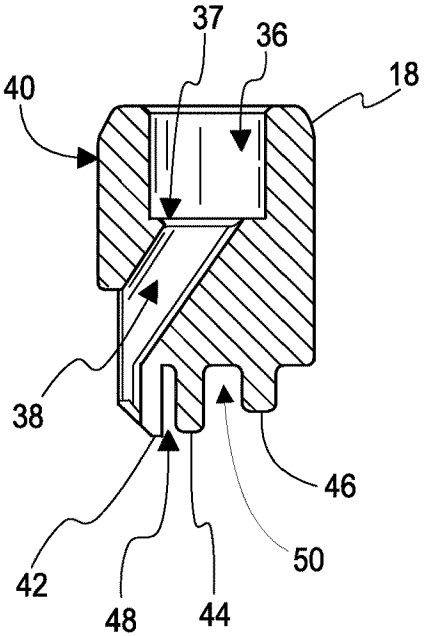
FIG. 6E is a cross-sectional bottom plan view of the strap guide of the door closer of FIG. 1.

The strap guide 18 is shown as an oblong, irregularly-shaped body having a generally triangular end profile, as best shown in FIG. 6C. Two of the corners of the triangular profile are rounded, and the third corner is truncated. The end profile may define a notch 34 adjacent the truncated corner, the notch defining a generally square interior corner. The notch 34 is configured to receive a corresponding corner of a portion of a door when the door closer 10 is attached thereto, as will be discussed further below.

The strap guide 18 defines a bore 36 extending inwardly from a first end of the body. The bore 36 is configured to receive the first end of the housing 12. The strap guide 18 defines a land 37 at the inner end of the bore 36. When the first end of the housing 12 is inserted into the bore 36, the first end of the housing may abut the land 37.

The strap guide 18 also defines a slot 38 extending obliquely inwardly from an exterior side surface 40 of the body 34 to the end of the bore 36 within the body 34. The bore 36 and the slot 38 are contiguous and are configured to receive the first end of the strap 16 in sliding engagement therethrough. Surfaces of the bore 36, the slot 38, and the interface therebetween that may come into contact with the strap 16 during normal use, as discussed further below, may be contoured and/or otherwise finished to enable sliding of the strap therethrough without resulting in undue abrasion or wear of the strap.

The strap guide 18 includes first, second, and third parallel and spaced apart tabs 42, 44, 46 extending longitudinally outwardly from a second end of the body 34. The first and second tabs 42, 44 cooperate to define a first groove 48 therebetween, and the second and third tabs 44, 46 cooperate to define a second groove 50 therebetween. The first, second, and third tabs 42, 44, 46 and first and second grooves 48, 50 are configured to engage with corresponding grooves and tabs of a frame of a door to which the door closer 10 may be attached, as will be discussed further below. In an embodiment, the door closer 10 may be attachable to such a door in other ways, and the first, second, and third tabs 42, 44, 46 and first and second grooves 48, 50 may be omitted.

Figure 7A:
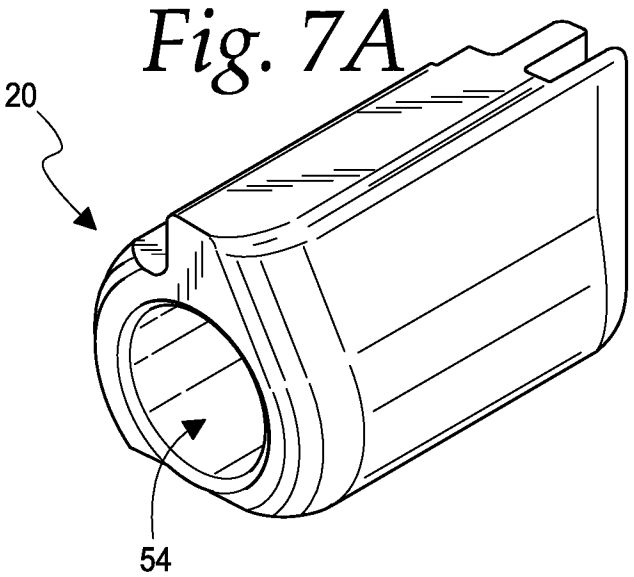
FIG. 7A is a perspective view of a spring anchor of the door closer of FIG. 1.
Figure 7C:
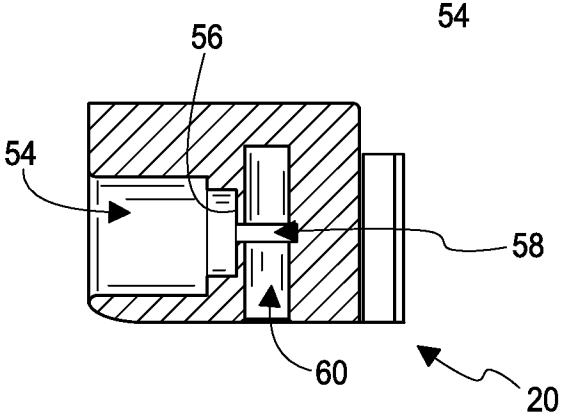
FIG. 7C is a cross-sectional side view of the spring anchor of the door closer of FIG. 1.
Figure 7D:
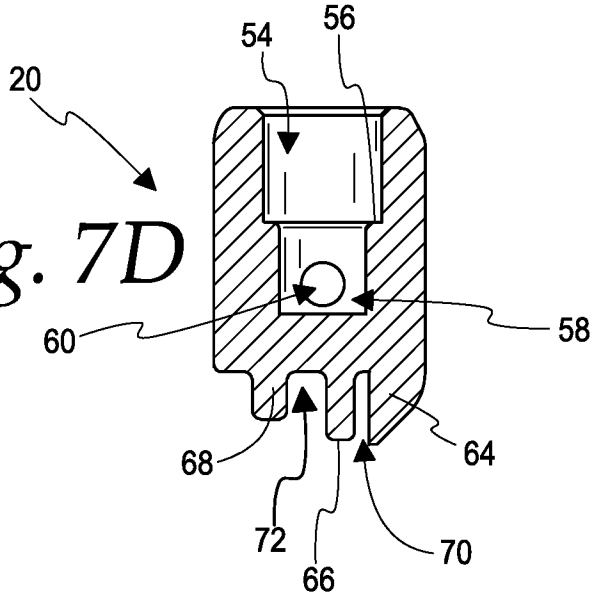
FIG. 7D is a cross-sectional top view of the spring anchor of the door closer of FIG. 1.
Figure 7B:
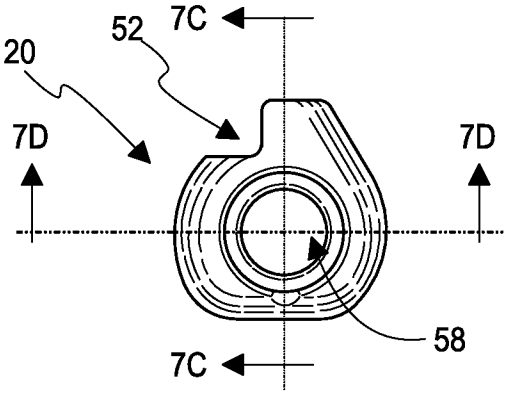
FIG. 7B is a first end view of the spring anchor of the door closer of FIG. 1.

The spring anchor 20 is shown as an irregularly-shaped, oblong body having a generally truncated triangular end profile, as best shown in FIG. 7B. Two of the corners of the triangular profile are rounded, and the third corner is truncated. The end profile may define a notch 52 adjacent the truncated corner, the notch defining a generally square interior corner. The notch 52 is configured to receive a corresponding corner of a portion of a door when the door closer 10 is attached thereto, as will be discussed further below.

The spring anchor 20 defines a first bore 54 extending longitudinally inwardly from a first end of the body. The bore 54 is configured to receive the second end of the housing 12. The spring anchor 20 defines a land 56 at the inner end of the bore 54. When the second end of the housing 12 is inserted into the bore 54, the second end of the housing may abut the land 56.

An axially-directed slot 58 extends longitudinally inwardly from the interior end of the bore 54. The slot 58 is configured to receive the second spring hook 24. In an embodiment, the slot 58 is sufficiently narrow to preclude rotation therein of the second spring hook 24 about a diametric axis of the second spring hook.

A second bore 60 extends radially inwardly from an outer surface of the spring anchor 20, to and beyond the slot 58. The second bore 60 is configured to receive a screw 62 or other structure configured to pin the second spring hook 24 to the spring anchor 20 at or within the slot 58.

The spring anchor 20 includes first, second, and third parallel and spaced apart tabs 64, 66, 68 extending longitudinally outwardly from a second end of the body. The first and second tabs 64, 66 cooperate to define a first groove 70 therebetween, and the second and third tabs 66, 68 cooperate to define a second groove 72 therebetween. The first, second, and third tabs 64, 66, 68 and the first and second grooves 70, 72 are configured to engage with corresponding grooves and tabs of a door frame to which the door closer 10 may be attached, as will be discussed further below. In an embodiment, the door closer 10 may be attachable to such a door in other ways, and the first, second, and third tabs 64, 66, 68 and the first and second grooves 70, 72 may be omitted.

The door closer 10 may be assembled by connecting the first spring hook 22 to the second or third anchor point 28, 30 of the strap 16. Typically, upon initial assembly of the door closer 10, the first spring hook 22 would be connected to the second anchor 28 point of the strap.

The foregoing sub-assembly may be disposed within the housing 12, with the second spring hook 24 extending from the second end of the housing 12. The second spring hook 24 may be inserted into the slot 58 of the spring anchor 20. The screw 62 may be screwed into the second bore 60 of the spring anchor 20 and through the second spring hook 24, thereby securing the second spring hook to the spring anchor.

The second end of the housing 12 may be inserted into the first bore 54 of the spring anchor 20, so that the second end of the housing abuts the land 56.

The first end of the strap 16 may be threaded through the bore 36 and then the slot 38 of the strap guide 18 so that the first end of the strap extends through and beyond the slot of the strap guide.

The first end of the housing 12 may be inserted into the bore 36 of the strap guide 18, so that the first end of the housing abuts the land 37.

The relative dimensions of the housing 12, the bore 36 of the strap guide 18, and the first bore 54 of the spring anchor 20 may be selected so that friction between these components tends to retain them to each other.

The assembled door closer may be attached to the door 110 and door jamb 120 by connecting the strap guide 18 and the spring anchor 20 to the door and connecting the first anchor point 26 of the strap 16 to the doorjamb.

As suggested above, the door 110 may include a frame defining one or more grooves and tabs corresponding to one or more of the tabs and grooves of the strap guide 18 and the spring anchor 20, and one or more of the tabs and grooves of the strap guide and the spring anchor may be engaged with the corresponding one or more grooves and tabs of the door.

Figure 8:
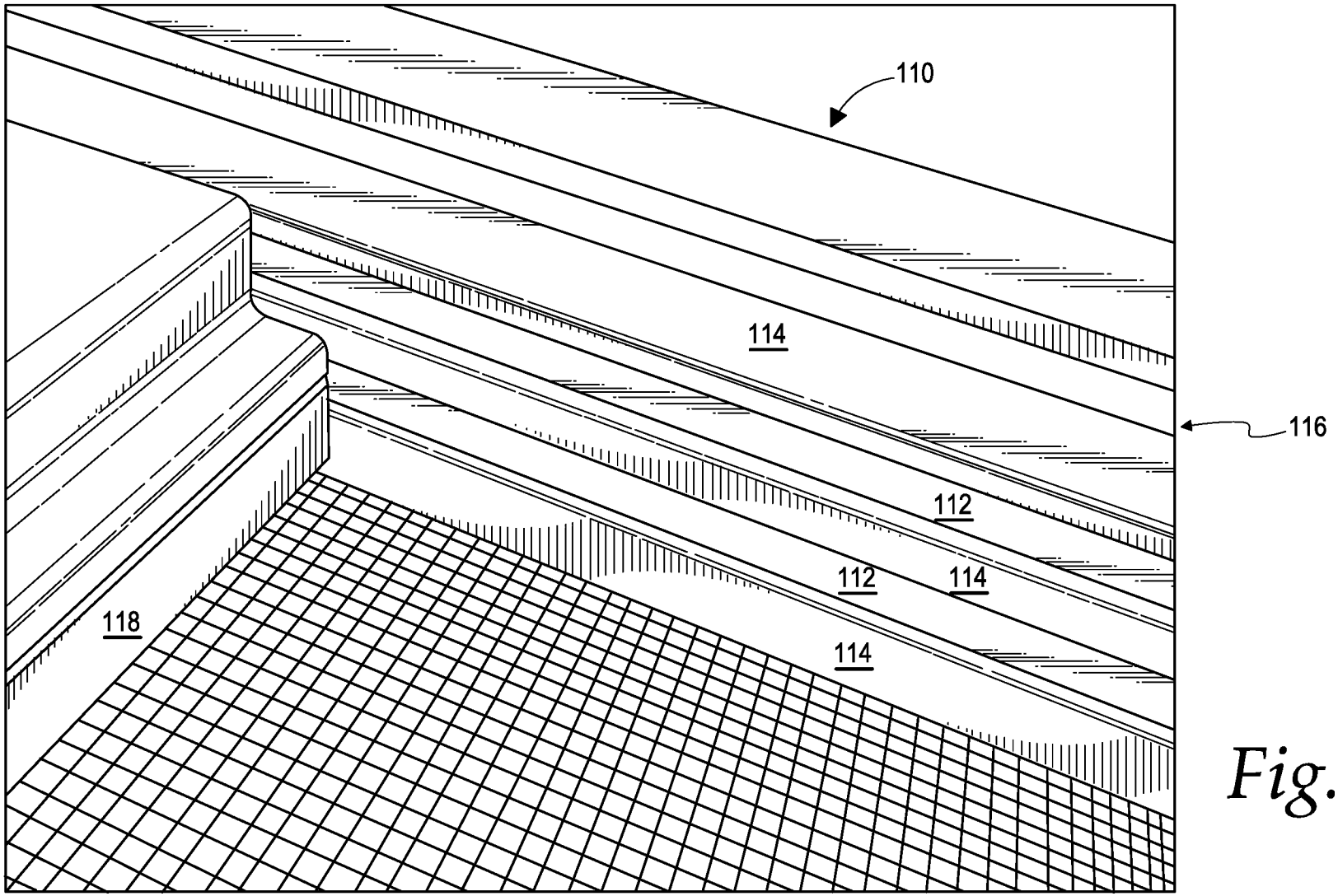
FIG. 8 is a detail perspective view of a portion of a door configured for receiving the door closer of FIG. 1.
Figure 9:
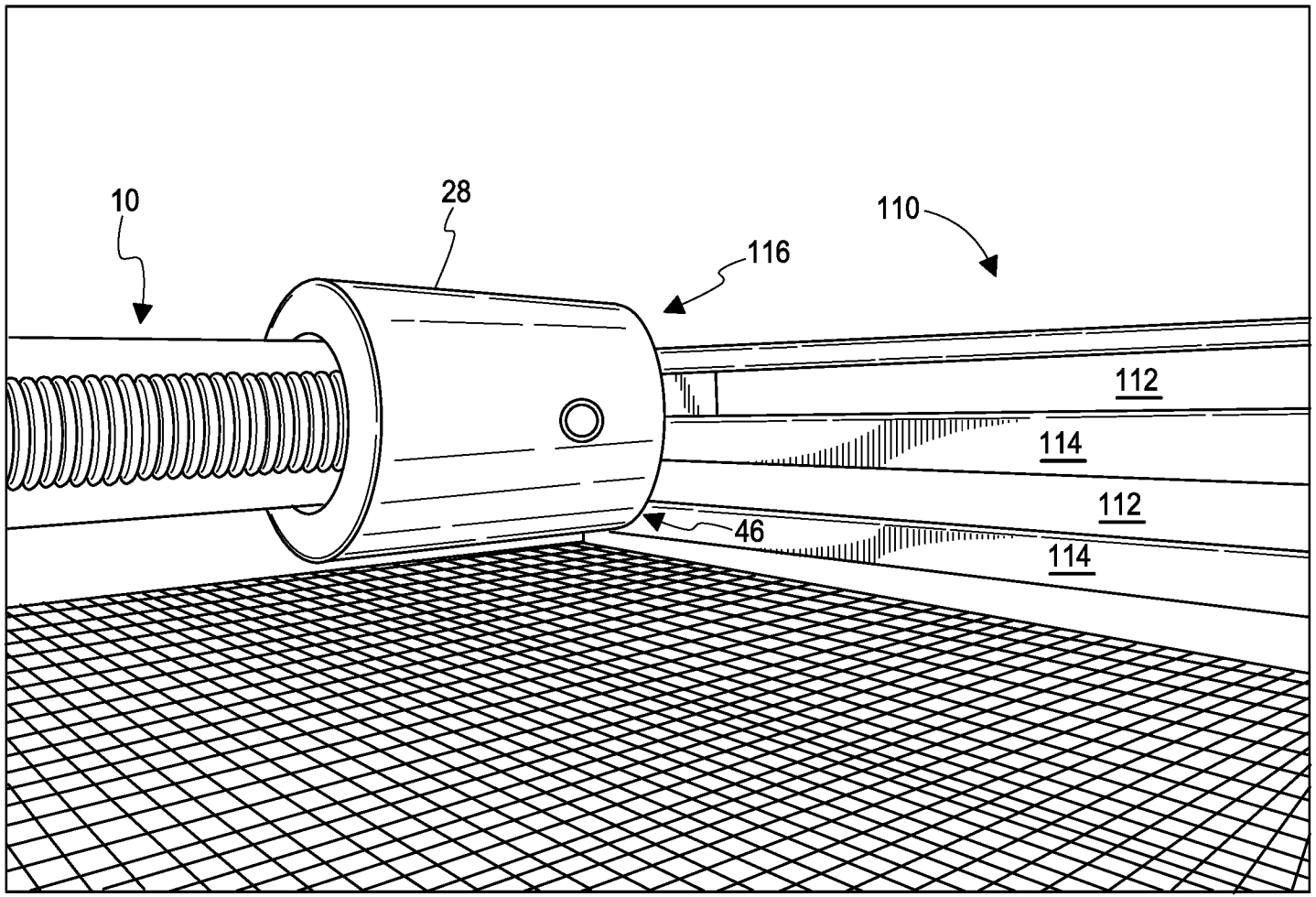
FIG. 9 is a detail view of the portion of the door of FIG. 8 with the door closer of FIG. 1 received therein.

For example, FIGS. 8 and 9 show the portion of the frame of the door 110 including grooves 112 and tabs 114 corresponding to the tabs 66, 68 and grooves 70, 72 of the spring anchor 20. The grooves 112 of the door 110 are configured to receive, for example, slidingly receive, the tabs 66, 68 of the spring anchor 20, and the tabs 114 of the door are configured to be received, for example, slidingly received, within the grooves 70, 72 of the spring anchor. In the illustrated embodiment, the grooves 112 and tabs 114 of the door 110 are elements of an extruded member at least partially defining the frame of the door. Another, for example, opposing, portion of the frame of the door 110 may be similarly configured to receive the strap guide 18 in a similar manner.

As best shown in FIGS. 8 and 9, at least one of the tabs 114 of the door 110 may be locally deformed to locally narrow the adjacent groove 112 of the door, thereby defining a pinch point 116. The width of the groove 112 at the pinch point 116 is less than the thickness of the corresponding tab 46 of the spring anchor 20. As such, the tab 46 of the spring anchor 20 cannot freely slide in the corresponding groove 112 past the pinch point 116. The tab 46, however, may be forced past the pinch point 116 install the door closer 10 to, and remove the door closer from, the door 110, as discussed further below. The pinch point 116 may be provided adjacent a hard stop, for example, a mullion 118 of the door 110.

The door closer 10 may be connected to the door 110 by tilting the door closer with respect to the door, inserting the tabs and grooves of one of the strap guide 18 and the strap anchor 20 into the corresponding grooves 112 and tabs 114 of a first portion of the frame of the door, near the mullion 118, inserting the tabs and grooves of the other of the strap guide and the strap anchor into the corresponding grooves and tabs of a second portion of the frame of the door, distant from the mullion, and then pivoting the door closer to place the other of the strap guide and the strap anchor against the mullion, thereby snapping the tabs and grooves of the other of the strap guide and the strap anchor past the pinch point 116 so that the tabs and grooves of the strap anchor and the spring anchor are secured between the mullion and the respective pinch points. The door closer 10 could be removed from the door 110 by reversing the foregoing procedure.

The free end of the strap 16 may be connected to the door jamb 120, for example, by inserting a screw 122 through the first anchor point 26 of the strap and driving the screw into the doorjamb.

After a period of use of the door closer 10, the spring 14 may plastically stretch, thereby reducing its efficacy in closing the door 110 to which it is connected. This situation may be remedied by removing the door closer 10 from the door 110, at least partially disassembling the door closer, disconnecting the first spring hook 22 from the second anchor point 28 of the strap 16, connecting the first spring hook to the third anchor point 30 of the strap, reassembling the door closer, and reattaching the door closer to the door.

References to orientation herein, for example, left right, upper, lower, top, bottom, front, rear, and the like, should be construed as references to relative orientation and not absolute orientation unless context dictates otherwise.

Illustrative embodiments of a door closer are shown and described herein. Features disclosed in connection with a given embodiment may be incorporated into other embodiments to the greatest extent possible. The embodiments disclosed herein are illustrative and should not be deemed to limit the scope of the invention as defined by the appended claims.

The invention claimed is:

1. A door closer comprising:

an elongated housing having a first end and a second end;

a strap guide operably associated with the first end of the housing;

a spring anchor operably associated with the second end of the housing;

a spring disposed within the housing, the spring having a first end and a second end, the second end of the spring connected to the spring anchor and fixed relative to the housing; and a strap having a first end and a second end, the strap slidingly engaged with the strap guide, the second end of the strap connected to the first end of the spring within the housing, wherein the strap defines a first anchor point proximate the first end thereof and a second anchor point proximate the second end thereof, wherein the strap defines a third anchor point between the first anchor point and the second anchor point, the third anchor point proximate the second anchor point and spaced longitudinally from the second anchor point, and wherein the first end of the spring is attachable to the second end of the strap within the housing at either of the second anchor point and the third anchor point, the second and third anchor points defining alternative spaced anchor points within the housing for the first end of the spring.

2. The door closer of claim 1 further comprising a grommet operably associated and in registration with a respective one of the anchor points.

3. The door closer of claim 1, wherein the strap guide is connected to the first end of the housing or the spring anchor is connected to the second end of the housing.

4. The door closer of claim 1, wherein the strap guide is connected to the first end of the housing and the spring anchor is connected to the second end of the housing.

5. The door closer of claim 1 wherein at least one of the strap guide and the spring anchor defines a recess configured to receive the respective first end or second end of the housing.

6. The door closer of claim 1 wherein the strap guide comprises a body defining:

an outer surface;

a recess having an inner surface configured to receive the first end of the housing; and a slot extending from the inner surface of the recess through the outer surface.

7. The door closer of claim 1 wherein at least one of the strap guide and the spring anchor comprises a body having an end defining a plurality of tabs and a slot therebetween, the tabs and slot configured for engagement with corresponding slots and a tab of a door frame.

8. The door closer of claim 1 wherein at least one of the strap guide and the spring anchor comprises a body defining a notch configured for engagement with a corresponding portion of a door frame.

9. A door closer comprising:

an elongated housing having a first end and a second end;

a strap guide connected to the first end of the housing;

a spring anchor connected to the second end of the housing;

a coil spring disposed within the housing, the spring having a first end and a second end, the second end of the spring connected to the spring anchor; and a strap having a first end and a second end, the strap slidingly engaged with the strap guide, the second end of the strap connected to the first end of the spring, the first end of the strap extending outwardly from the strap guide and the housing, wherein the strap defines a first anchor point proximate the first end thereof and a second anchor point proximate the second end thereof, wherein the strap defines a third anchor point between the first anchor point and the second anchor point, the third anchor point proximate the second anchor point and spaced longitudinally from the second anchor point, wherein the second and third anchor points are configured as alternative anchor points for the first end of the spring, and wherein at least the second and third anchor points are disposed within the housing such that adjustments between the alternative anchor points require disassembly of the housing.

10. The door closer of claim 9, at least one of the strap guide and the strap anchor comprising a body having an end defining a plurality of tabs and a slot therebetween, the tabs and slot configured for engagement with corresponding slots and a tab of a door frame.

11. The door closer of claim 10, the at least one of the strap guide and the strap anchor defining a notch configured for engagement with a corresponding portion of the door frame.

12. The door closer of claim 9, at least one of the strap guide and the strap anchor comprising a body having an end defining a bore configured to receive the respective end of the housing.

13. The door closer of claim 9 wherein the strap guide comprises a body defining:

an outer surface;

a recess having an inner surface configured to receive the first end of the housing; and a slot extending from the inner surface of the recess through the outer surface.

* * * * *